US005300383A

United States Patent [19]

Tsubota et al.

[11] Patent Number: 5,300,383

[45] Date of Patent: Apr. 5, 1994

[54] METHOD AND TONER FOR FULL COLOR DEVELOPMENT

[75] Inventors: Noriaki Tsubota, Himeji; Masahiko Kubo, Yao; Kazuo Fuji, Higashi-osaka; Kazuhisa Edahiro, Hirakata, all of Japan

[73] Assignee: Mita Industrial Co., Ltd., Osaka, Japan

[21] Appl. No.: 95,697

[22] Filed: Jul. 22, 1993

Related U.S. Application Data

[63] Continuation-in-part of Ser. No. 970,610, Oct. 27, 1992, abandoned, which is a continuation of Ser. No. 615,915, Nov. 20, 1990, abandoned.

[30] Foreign Application Priority Data

| | | | |
|---|---|---|---|
| Nov. 20, 1989 | [JP] | Japan | 1-299718 |
| Nov. 20, 1989 | [JP] | Japan | 1-299719 |
| Nov. 22, 1989 | [JP] | Japan | 1-301997 |
| Nov. 22, 1989 | [JP] | Japan | 1-301998 |
| Nov. 22, 1989 | [JP] | Japan | 1-301999 |
| Nov. 22, 1989 | [JP] | Japan | 1-302000 |

[51] Int. Cl.[5] ..... G03G 13/01; G03G 9/09

[52] U.S. Cl. ..... 430/45; 430/106; 430/111

[58] Field of Search ..... 430/45, 106, 111

[56] References Cited

U.S. PATENT DOCUMENTS

| | | | |
|---|---|---|---|
| 4,312,932 | 1/1982 | Hauser et al. | 430/106 X |
| 4,590,139 | 5/1986 | Imai et al. | 430/45 |

*Primary Examiner*—Roland Martin

*Attorney, Agent, or Firm*—Sherman and Shalloway

[57] ABSTRACT

Disclosed is a toner having an excellent transparency for full color development, which comprises a binder resin and a magenta coloring dispersed therein wherein (i) said magenta coloring agent is a quinacridone pigment, (ii) said pigment is dispersed in the binder resin in the form of fine particles and that when the toner is formed into a layer having a thickness of 0.9 $\mu$m, the area occupied by the dispersed pigment in 780,000 $\mu m^2$ of the area of the formed surface is such that the number of dispersed pigment particles having a size of 10 to 12.5 $\mu m^2$ is smaller than 40 and the number of dispersed pigment particles having a size of 12.5 to 15.0 $\mu m^2$ is smaller than 20, and (iii) the binder resin has an electroconductivity of $1.0\times10^{-9}$ to $5.0\times10^{-9}$ (s/cm). The critical quantities of these dispersed particles having the above sizes differ among magenta, cyan and yellow toners. Each of these color toners has an excellent light-transmitting property, and therefore, these toners can be valuably used for the full color development where these toners are developed in the overlapped state on a transfer material to form a full color image.

13 Claims, 4 Drawing Sheets

METHOD AND TONER FOR FULL COLOR DEVELOPMENT

This is a continuation in part application of a patent application Ser. No. 07/970,610 filed Oct. 27, 1992 which is a continuation application of Ser. No. 07/615,915, Nov. 20,1990, both of the applications having been abandoned.

BACKGROUND OF THE INVENTION (1) Field of the Invention

The present invention relates to a toner for the full color development where a plurality of toners are overlapped on an image on a copying sheet. More particularly, the present invention relates to a toner for the full color development, in which development characteristics and transfer characteristics are made substantially equal in the toners to be overlapped.

Furthermore, the present invention relates to magenta, cyan and yellow toners among toners for the full color development. More particularly, the present invention relates to these toners having such an excellent transparency that when these toners are mingled on an image on a transfer sheet, the respective toners can show intended colors sharply.

(2) Description of the Related Art

In the fields of the electrophotography and electrostatic printing, toners are used for visualizing electrostatic latent images formed on image carriers. In these toners, a resin having desirable electroscopic and binding properties, for example, a styrene resin or a polyester resin, is used as the resin medium, and carbon black or other organic or inorganic coloring pigment is used as the coloring agent.

The full color development in which magenta, cyan, yellow and black color toners are overlapped to form an image has been recently proposed and worked.

In this full color development, a multiple-color original is exposed to light through a color-separating filter, this operation is repeated a plurality of times by using cyan, yellow and magenta color developers and a black toner, and toner images are thus overlapped to obtain a multiple-color image. Organic pigments are used as coloring agents for cyan, yellow and magenta toners used for this full color development, and carbon black is used for a black toner.

FIG. 7 is a diagram illustrating developing and transfer zones of an image-forming apparatus for obtaining a full color image. In this apparatus, an electrostatic latent image formed on a photosensitive drum 1 by appropriate means is visualized by a developer in any of developing devices 3*a*, 3*b*, 3*c* and 3*d* of a developing unit 2 and is then transferred by a transfer charger 5 onto a transfer material held on a transfer drum 4 by a gripper 6, from which electricity is removed by an electricity-removing charger 7. Furthermore, a toner image developed by a developer in another developing device of the devices 3*a*, 3*b*, 3*c* and 3*d* is transferred onto the transfer material by the transfer charger, and third and fourth color images are similarly transferred. Thus, a predetermined number of color images are transferred onto the transfer material held on the transfer drum 4, and the transfer material is delivered to a fixing step (not shown) to form a multiple-color image. In general, in the above-mentioned transfer step, an operation of transferring a toner of a different color onto a toner layer transferred on a transfer material is carried out. At this operation, it sometimes happens that the charge of the toner already transferred on the transfer material reduces the working transfer electric field at the transfer of the subsequent toner and therefore, an image having a desired hue cannot be reproduced. For obviating this disadvantage, there is sometimes adopted a method in which the transfer voltage is gradually elevated at the transfer step or the transfer voltage is elevated at the transfer of the third and subsequent toners where the toner layer becomes thick.

However, since behaviors of toners at the practical transfer step are delicate and complicated, even if a predetermined transfer voltage is applied and the value of the transfer voltage is elevated in the later stage, scattering of the toners or insufficient transfer is often caused because the respective color toners are different in various characteristics (such as charging characteristics and electric characteristics), and no satisfactory results can be obtained in formation of a toner image of a desirable hue.

Japanese Unexamined Patent Publication No. 01-32981 proposes a method in which the quantity of the charge of a toner to be developed and transferred is made larger than the absolute value of the already developed and transferred toner to compensate the reduction of the working transfer electric field and stabilize the transfer operation. According to this method, if it is intended to adopt common development conditions (charge characteristics of the photosensitive material, the development bias voltage and the sliding contact state between the photosensitive material and the developer carrier), since toners are extremely different in the charge characteristics, development unevenness (Insufficient density of the solid portion, thickening of line and dot images and formation of toner dusts in the peripheral portion of the image area) is caused or scattering of toners is caused in the machine, and a shear in the hue and a fog are often observed in the formed image.

It is important that color toners should be excellent not only in spectral reflection characteristics but also in spectral transmission characteristics, and if this requirement is not satisfied, an image having a hue similar to the inherent color cannot be obtained. When a full color image is formed by overlapping a plurality of color toners, it is especially important that a transparency should be given to the toners. If color toners poor in the transparency are used, the colors of the toners interfere with one another and the formed image becomes dark, and it often happens that an image of a desired color cannot be obtained.

As the means for overcoming the foregoing defects, there have been proposed a method in which a specific fluorine-containing acrylic resin is used as a binder resin medium (Japanese Unexamined Patent Publication No. 62-273569) and a method in which an oil-soluble dye such as C.I. Solvent Yellow 60 is incorporated into a yellow toner (Japanese Unexamined Patent Publication No. 62-273572).

However, even if these methods are adopted, the original image hue cannot be sharply reproduced by mingling the colors, and it often happens that the formed image becomes obscure and the characteristics of colors are not effectively utilized. Therefore, the problem cannot be solved by these methods.

SUMMARY OF THE INVENTION

It is therefore an object of the present invention to provide a toner for the full color development, which has a very high light-transmitting property.

Another object of the present invention is to provide a toner for the full color development, which has such an improved light-transmitting property that hues of respective toners overlapped at the color mingling step are sharply manifested.

Still another object of the present invention is to provide magenta, cyan and yellow toners among toners for the full color development.

A further object of the present invention is to provide toners for the full color development, the development characteristics and transfer characteristics of which are made substantially conformable to one another by diminishing the differences of electric characteristics among the respective toners.

A still further object of the present invention is to provide toners, the development characteristics and transfer characteristics of which are made equal to one another so that full color development excellent in the image reproducibility becomes possible without reduction of the chroma or unevenness of the density in the formed image.

In accordance with one aspect of the present invention, there is provided a toner having an excellent transparency for full color development, which comprises a binder resin and a magenta coloring agent dispersed therein wherein (i) said magenta coloring agent is a quinacridone pigment, (ii) said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed pigment particles having a size of 10 to 12.5 $\mu m^2$ (hereinafter defined as the number of the medium-large particles) is smaller than 40 and the number of dispersed pigment particles having a size of 12.5 to 15.0 $\mu m^2$ (hereinafter defined as the number of the large particles) is smaller than 20, and (iii) the binder resin has an electroconductivity of $1.0\times10^{-9}$ to $5.0\times10^{-9}$ (s/cm).

In this toner for the full color development, the melting temperature of the binder resin is preferably 80° to 130° C.

In accordance with another aspect of the present invention, there is provided a toner having an excellent transparency for full color development, which comprises a binder resin and a cyan coloring agent dispersed therein wherein (i) said cyan coloring agent is a copper phthalocyanine pigment, (ii) said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed pigment particles having a size of 10 to 12.5 $\mu m^2$ is smaller than 80 and the number of dispersed pigment particles having a size of 12.5 to 15.0 $\mu m^2$ is smaller than 50, and (iii) the binder resin has an electroconductivity of $1.0\times10^{-9}$ to $5.0\times10^{-9}$ s/cm).

In accordance with still another aspect of the present invention, there is provided a toner having an excellent transparency for full color development, which comprises a binder resin and a yellow coloring agent dispersed therein wherein (i) said yellow coloring agent is a benzidine pigment, (ii) said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed pigment particles having a size of 10 to 12.5 $\mu m^2$ is smaller than 15 and the number of dispersed pigment particles having a size of 12.5 to 15.0 $\mu m^2$ is smaller than 10, (iii) the binder resin has an electroconductivity of $1.0\times10^{-9}$ to $5.0\times10^{-9}$ (s/cm).

DETAILED DESCRIPTION OF THE PREFERRED EMBODIMENTS

As factors having influence on the transparency of the toner, there can be considered characteristics of the binder resin per se, for example, optical characteristics such as spectral reflecting and spectral transmitting properties, and the uniformity of the shape. However, it has hardly been considered that the state of dispersion of the coloring agent in the binder resin has significant influences on the transparency of the toner. We examined this dispersion state hardly marked in the past and made investigations about this dispersion state, and as the result, we have now completed the present invention.

More specifically, we found that if the binder resin is kneaded with the coloring agent until a specific dispersion state of the coloring agent is attained and the coloring agent is uniformly dispersed in the form of predetermined fine particles, a color toner having an excellent light-transmitting property in the visible region, as not observed in conventional toners, can be obtained. A preferred dispersion state of a coloring agent and a preferred amount of the dispersed coloring agent for each of full color development toners to be overlapped, especially magenta, cyan and yellow toners, were examined. As the result, we have now completed the present invention.

A conventional organic coloring agent has a primary particle diameter of about 0.1 to 0.2 μm in the as-prepared state, but since particles are readily agglomerated at the drying step, the secondary particle size is in a broad range of from several μm to several hundreds μm. In conventional toners, a coloring agent having such a particle size is mainly dispersed in a resin.

In contrast, in the toner of the present invention, of dispersed coloring agent particles in the resin, the amounts of particles having a size of 10 to 12.5 $\mu m^2$ and particles having a size of 12.5 to 15.0 $\mu m$ are limited below certain levels. These particles, the presence of which is restricted, correspond mainly to secondary particles. The toner in which the particles are restricted has an excellent light-transmitting property in the visible region except the wavelength absorption region of the coloring agent. We also found that allowable numbers of coloring agent particles having a size of 10 to 12.5 $\mu m^2$ and coloring agent particles having a size of 12.5 to 15.5 $\mu m^2$ in the resin differ among magenta, cyan and yellow toners.

Figure 1:
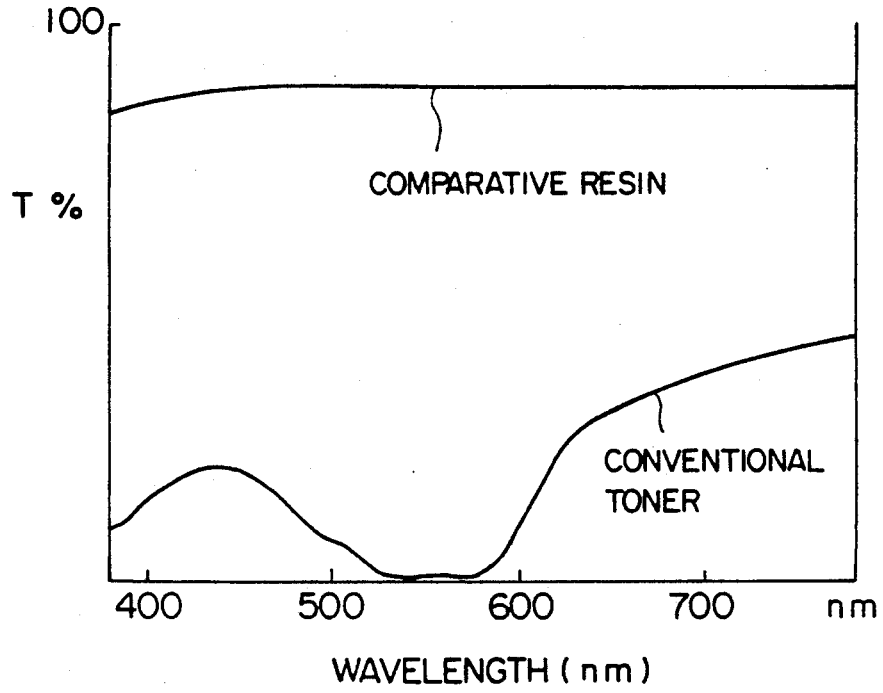
FIG. 1 is a characteristic curve illustrating the transmission of a conventional toner comprising a magenta coloring agent.
Figure 2:
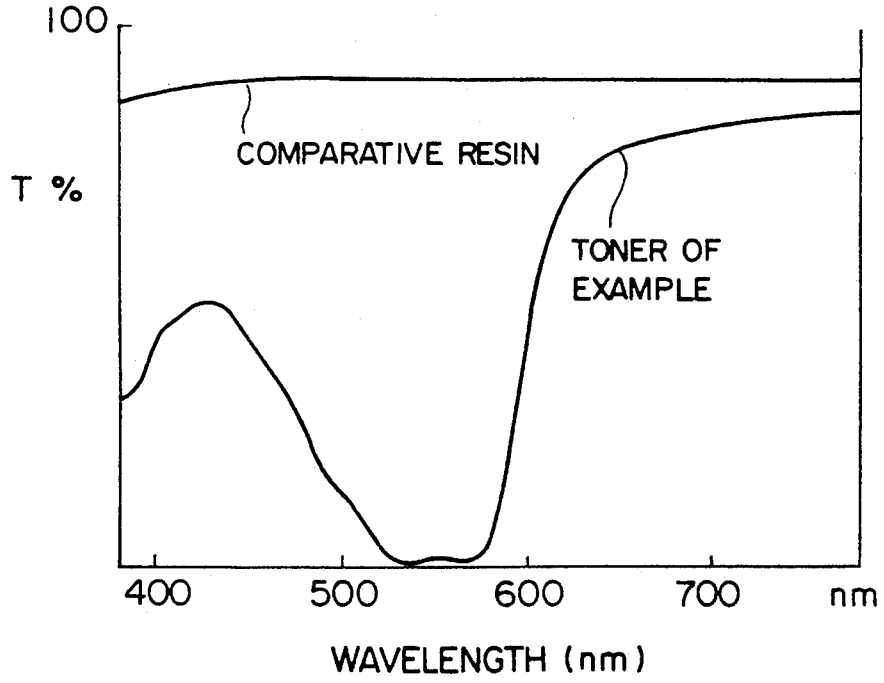
FIG. 2 is a characteristic curve illustrating the transmission of a toner of the present invention comprising a magenta coloring agent.

FIG. 1 shows the results of the examination of the transmission T (%) of a conventional toner comprising a magenta coloring agent (the number of the medium-large particles is 120 and the number of the large particles is 80) at a wavelength in the visible region, and FIG. 2 shows the results of the examination of the transmission T (%) of a toner having a magenta coloring agent appropriately dispersed in a resin according to the present invention (the toner according to Experiment No. 1-1), at a wavelength in the visible region. As is seen from FIGS. 1 and 2, these magenta toners show substantially the same absorption values at a wavelength of about 500 to 600 nm, but in other areas of the visible region (wavelengths shorter than 500 nm and longer than 600 nm), they do not absorb lights but transmit them. Furthermore, it is understood that in the above region, the conventional toner is poor in the light-transmitting property. In contrast, the magenta toner of the present invention exerts the same action as that of the conventional toner in the inherent absorption region of the coloring agent, but the toner of the present invention is excellent in the light-transmitting property in other visible region. Accordingly, the toner of the present invention is suitably used as a toner for the full color development and provides an image excellent in the reproducibility.

In the magenta toner of the present invention, it is important that when the toner is formed into a layer having a thickness of 0.9 $\mu m$ as a measurement sample, the area occupied by the dispersed magenta coloring agent in 780,000 $\mu m^2$ of the area of the formed surface is such that the number of dispersed pigment particles having a size of 10 to 12.5 $\mu m^2$ (hereinafter defined as the number of the medium-large particles) is smaller than 40, especially smaller than 30, and the number of dispersed pigment particles having a size of 12.5 to 15.0 $\mu m^2$ (hereinafter defined as the number of the large particles) is smaller than 20, especially smaller than 10. In case of the magenta toner, if the number of the above-mentioned coloring agent particles is within the above-mentioned range, a sufficient light-transmitting property can be obtained, but if the number of the above-mentioned coloring agent particles exceeds the above-mentioned range, the light-transmitting property is degraded. The reason why the transparency of the toner is improved by restricting the presence of coloring agent particles having such a large size has not been elucidated, but it is believed that many coloring agent particles having a primary particle size are present in the binder, they are uniformly dispersed and polymeric films of the resin wet-adhere to the entire surfaces of the coloring agent particles.

In the above-mentioned magenta toner, a quinacridone pigment is preferably used as the coloring agent. The quinacridone pigment has a good dispersibility in a resin, and the above-mentioned requirements of the numbers of particles having the above-mentioned particle sizes are satisfied. Thus, the quinacridone pigment has a good dispersibility in a binder resin, and a toner comprising the quinacridone pigment has uniform electric characteristics and is excellent in the light-transmitting and spectral characteristics.

Figure 3:
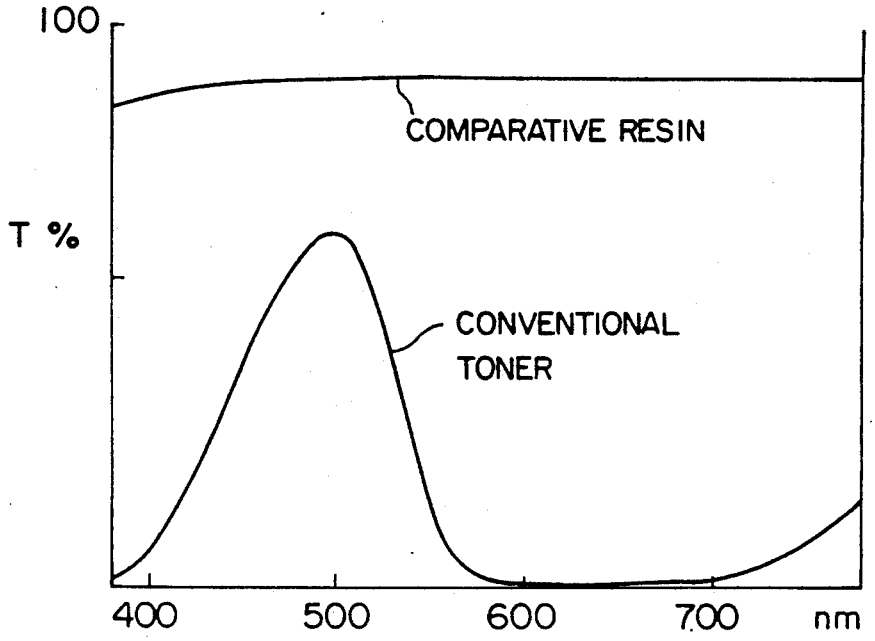
FIG. 3 is a characteristic curve illustrating the transmission of a conventional toner comprising a cyan coloring agent.
Figure 4:
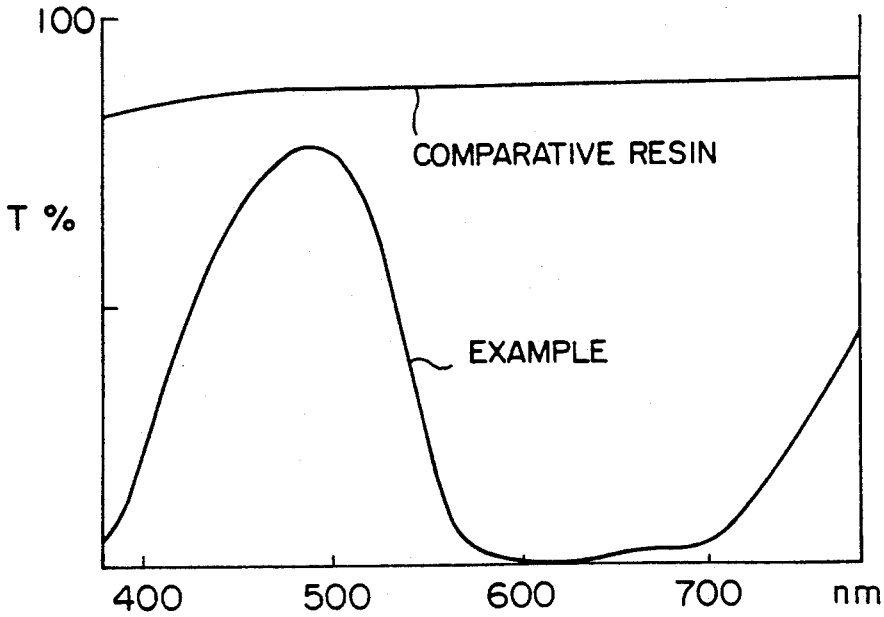
FIG. 4 is a characteristic curve illustrating the transmission of a toner of the present invention comprising a cyan coloring agent.

FIG. 3 shows the results of the examination of the transmission T (%) of a conventional toner comprising a cyan coloring agent (the number of the medium-large particles is 110 and the number of the large particles is 80) at a wavelength in the visible region, and FIG. 4 shows the results of the examination of the transmission T (%) of a toner having a cyan coloring agent appropriately dispersed in a resin according to the present invention (the toner according to Experiment No. 2-1), at a wavelength in the visible region. As is seen from FIGS. 3 and 4, these cyan toners show substantially the same absorption values at a wavelength of about 600 to 700 nm, but in the wavelength region of about 500 nm, they do not absorb lights but transmit them. Furthermore, it is understood that in the above region, the conventional toner is poor in the light-transmitting property. In contrast, the cyan toner of the present invention exerts the same action as that of the conventional toner in the inherent absorption region of the coloring agent, but the toner of the present invention is excellent in the light-transmitting property in other visible region. Accordingly, the toner of the present invention is suitably used as a toner for the full color development and provides an image excellent in the reproducibility.

In the cyan toner of the present invention, it is important that when the toner is formed into a layer having a thickness of 0.9 $\mu m$ as a measurement sample, the area occupied by the dispersed cyan coloring agent in 780,000 $\mu m^2$ of the area of the formed surface is such that the number of dispersed coloring agent particles having a size of 10 to 12.5 $\mu m^2$ is smaller than 80, especially smaller than 70, and the number of dispersed coloring agent particles having a size of 12.5 to 15.0 $\mu m^2$ is smaller than 50, especially smaller than 40. In case of the cyan toner, if the number of the above-mentioned coloring agent particles is within the above-mentioned range, a sufficient light-transmitting property can be obtained, but if the number of the above-mentioned coloring agent particles exceeds the above-mentioned range, the light-transmitting property is degraded.

In the above-mentioned cyan toner, a copper phthalocyanine pigment is preferably used as the coloring agent. The copper phthalocyanine pigment has a good dispersibility in a resin, and the above-mentioned requirements of the numbers of particles having the above-mentioned particle sizes are satisfied. Thus, the copper phthalocyanine pigment has a good dispersibility in a binder resin, and a toner comprising the copper phthalocyanine pigment has uniform electric characteristics and is excellent in the light-transmitting characteristics.

Figure 5:
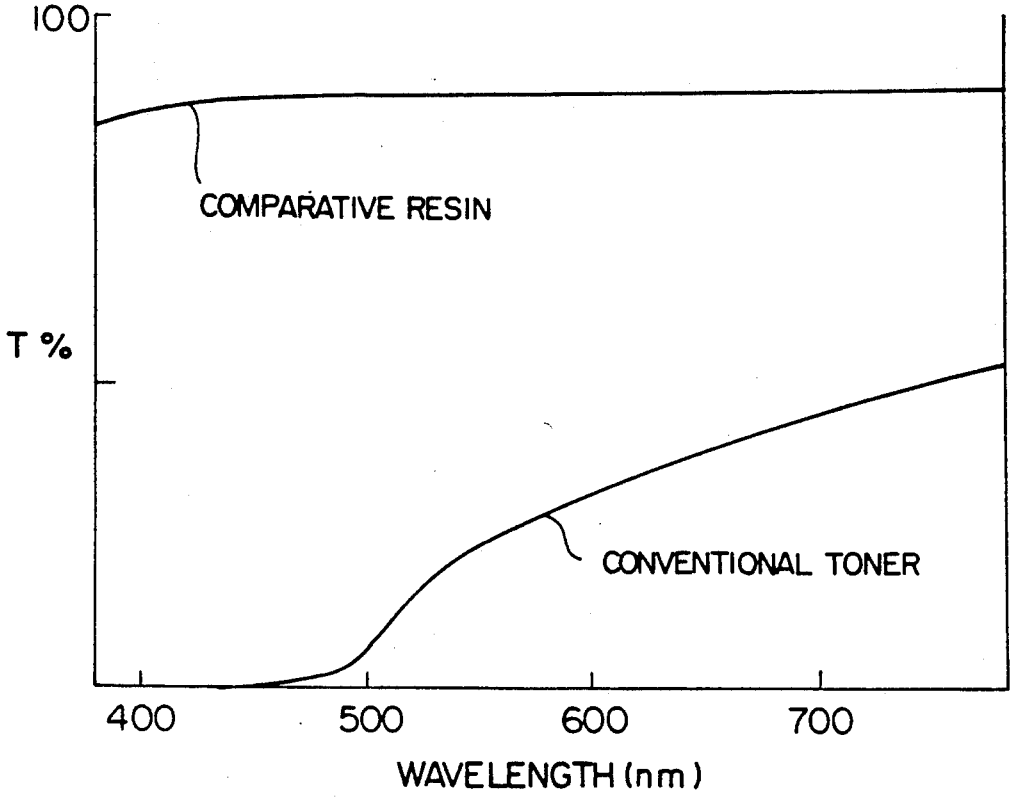
FIG. 5 is a characteristic curve illustrating the transmission of a conventional toner comprising a yellow coloring agent.
Figure 6:
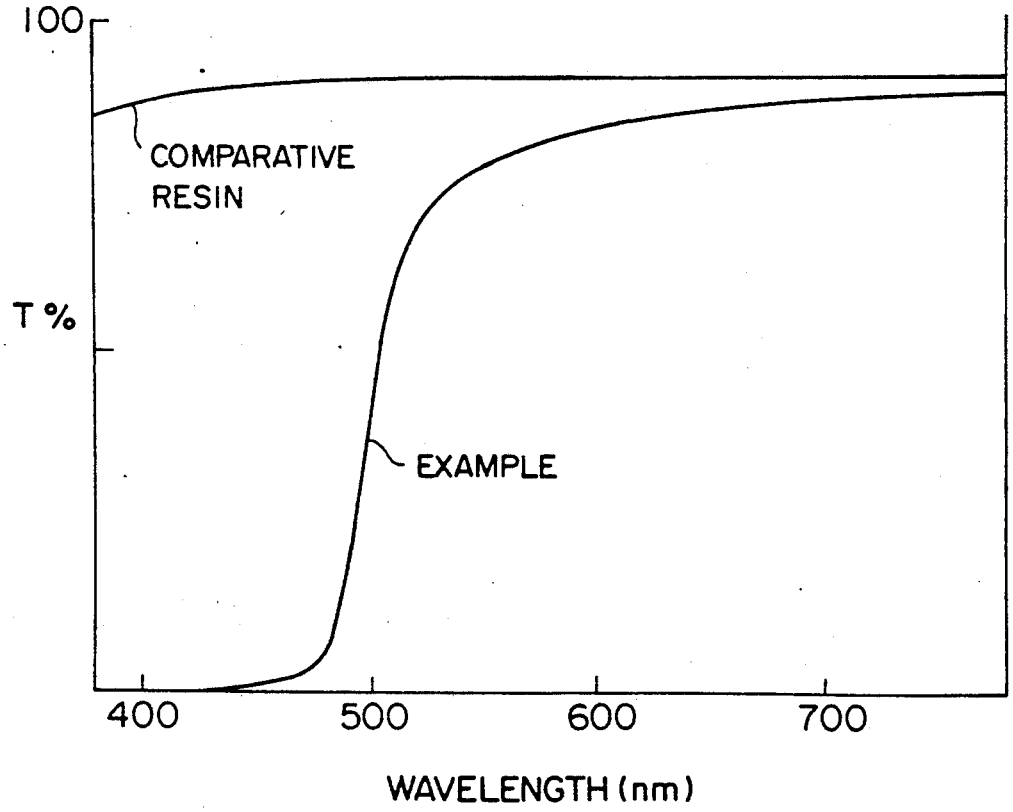
FIG. 6 is a characteristic curve illustrating the transmission of a toner of the present invention comprising a yellow coloring agent.
Figure 7:
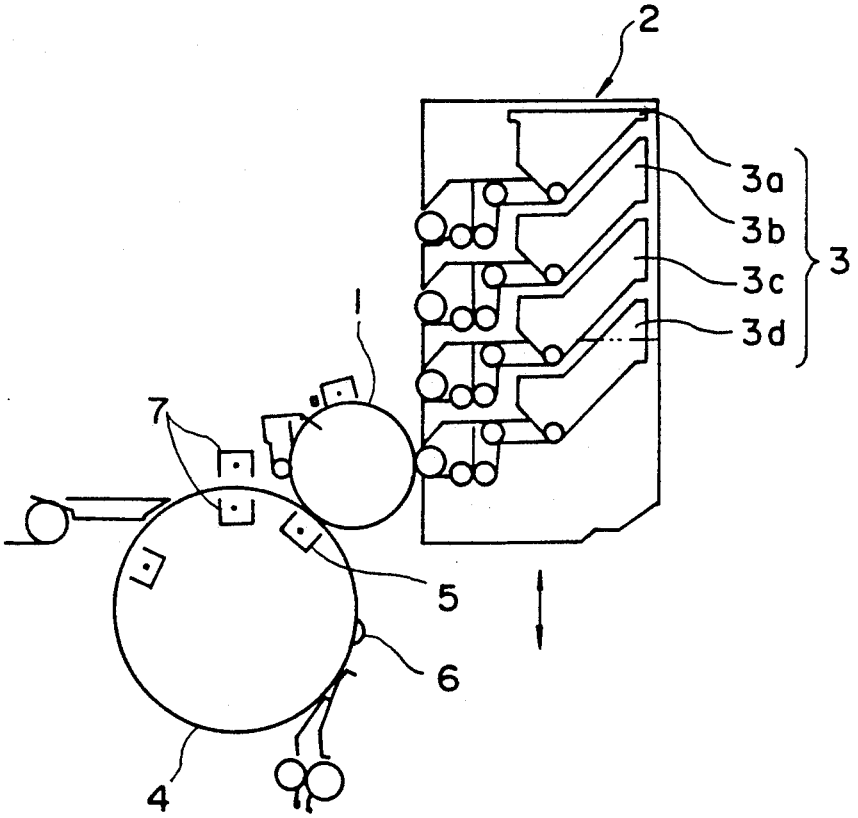
FIG. 7 is a diagram illustrating the principle of a full color development apparatus.

FIG. 5 shows the results of the examination of the absorption wavelengths of a conventional toner comprising a yellow coloring agent (the number of the medium-large particles is 30 and the number of the large particles is 25) in the visible region, and FIG. 6 shows the results of the examination of the absorption wavelengths of a toner having a yellow coloring agent appropriately dispersed in a resin according to the present invention (the toner according to Experiment No. 3-1), in the visible region. As is seen from FIGS. 5 and 6, these yellow toners show substantially the same absorption values at a wavelength of about 400 nm, but in other areas of the visible region (wavelengths longer than 500 nm), they do not absorb lights but transmit them. Furthermore, it is understood that in the above region, the conventional toner is poor in the light-transmitting property. In contrast, the yellow toner of the present invention exerts the same action as that of the conventional toner in the inherent absorption region of the coloring agent, but the toner of the present invention is excellent in the light-transmitting property in other visible region. Accordingly, the toner of the present invention is suitably used as a toner for the full color development and provides an image excellent in the reproducibility.

In the yellow toner of the present invention, it is important that when the toner is formed into a layer having a thickness of 0.9 μm as a measurement sample, the area occupied by the dispersed yellow coloring agent in 780,000 $\mu m^2$ of the area of the formed surface is such that the number of dispersed coloring agent particles having a size of 10 to 12.5 $\mu m^2$ is smaller than 15. especially smaller than 10, and the number of dispersed coloring agent particles having a size of 12.5 to 15.0 $\mu m^2$ is smaller than 10, especially smaller than 5. In case of the yellow toner, if the number of the above-mentioned coloring agent particles is within the above-mentioned range, a sufficient light-transmitting property can be obtained, but if the number of the above-mentioned coloring agent particles exceeds the above-mentioned range, the light-transmitting property is degraded.

In the above-mentioned yellow toner, a benzidine pigment is preferably used as the coloring agent. The benzidine pigment has a good dispersibility in a resin, and the above-mentioned requirements of the numbers of particles having the above-mentioned particle sizes are satisfied. Thus, the benzidine pigment has a good dispersibility in a binder resin, and a toner comprising the benzidine pigment has uniform electric characteristics and is excellent in the light-transmitting characteristics.

As explained hereinabove, the transparency of a full color toner is not affected by the average particle diameter of organic coloring agent particles dispersed in a binder resin, but markedly by the number of coarse particles having an area of 10 to 12.5 $\mu m^2$ and 12.5 to 15.0 $\mu m^2$, and the number of coarse particles affecting this transparency differs by the type of magenta, cyan and yellow. The novel characteristics of this invention reside in finding the allowable ranges according to this type.

In the full color toners of this invention, the present transmissions of light rays other than a light ray having a specified wavelength to be absorbed by specified coloring agent particles are markedly increased. For this purpose, only a small amount of coarse particles having the above-mentioned size should be present in a binder resin. Accordingly, an organic coloring agent is not coalesced in the form of secondary particles, but should be dispersed in the form of fine primary particles in the binder resin.

A wet pigment cake, as prepared, is hot-kneaded in the presence of a surface-active agent or a dispersant together with a toner binder resin to move the unaggregated pigment particles from the aqueous phase to the oil phase (resin phase) (so-called flushing) can be advantageously applied to fine division and dispersion. By mixing a toner master batch produced by flushing with a toner binder resin, the desired toner-marking kneaded composition in the dispersed state can be obtained.

In the present invention, it is important that the electroconductivity of the binder resin should be in the range of from $1.0\times10^{-9}$ to $5.0\times10^{-9}$ (s/cm), and it is especially preferred that the electroconductivity of the binder resin be in the range of from $1.0\times10^{-9}$ to $3.0\times10^{-9}$ (s/cm). If the electroconductivity of the binder resin is below the above-mentioned range, a great difference of the electroconductivity is produced among toners to be overlapped, and also great differences are produced in the development and transfer characteristics. For example, as shown in Experiment 4-5 (Table 4) given hereinafter, if a binder resin having such a low electroconductivity as $8.9\times10^{-10}$ s/cm is used, carbon black raises up the electroconductivity of the entire toner to $1.5\times10^{-9}$ s/cm, while other toners such as cyan, magenta and yellow toners show an electroconductivity of an order of $10\times10^{-10}$ s/cm, and coloring agents fail to show such a prominent increase of the electroconductivity as attained by carbon black. Therefore, differences of the electroconductivity are produced among the overlapped toners.

In contrast, if a binder resin having an electroconductivity included within the above-mentioned range, no difference of the electroconductivity is found among the magenta, cyan and yellow toners of the present invention, for example, as shown in Experiments 4-1 and 4-2 concerning the magenta toner. If the full color development is carried out by using toners, among which there is substantially no difference of the electroconductivity, the development and transfer characteristics are substantially the same among the respective color toners, and an excellent image reproducibility is attained. On the other hand, if the electroconductivity of the binder resin exceeds the above-mentioned range, even if charges are applied to toners, escape of the charges is delayed and the charging state becomes unstable.

If the binder resin has an electroconductivity included within the above-mentioned range, the toner of the present invention has satisfactory electric characteristics, and the resin of the toner of the present invention may be the same as or different from binder resins of other toners used simultaneously with the toner of the present invention. Incidentally, it is important that each of the binder resins of other toners should satisfy the above-mentioned requirements of the electroconductivity.

In the Present invention, it also is important that the melting temperature of the binder resin should be in the range of from 80° to 130° C., preferably from 90° to 110° C. If the melting temperature of the binder resin is within the above-mentioned range, an excellent coloring property is attained if respective toners are overlapped. If the melting temperature of the binder resin exceeds the above-mentioned range, the coloring property is degraded, and if the melting temperature of the binder resin is too low and below the above-mentioned range, the offset phenomenon is sometimes caused.

The toner for the full color development according to the present invention will now be described in detail.

The toner of the present invention is a toner for the full color development, which is used in the state where the toner is overlapped on other toners differing in the color on an image on a transfer sheet. Namely, the present invention is directed to a toner forming a basic color in the full color development. Basic toners for the full color development include four toners, that is, magenta, cyan, yellow and black toners. In the full color development, these toners are developed in order in the overlapped state, and the hue and image quality of an original are reproduced. Each of these toners comprises a coloring agent and, if desired, a charge-controlling agent in a binder resin, and a known toner can be further incorporated in or added to the toner.

Binder Resin

A known resin can be used as the binder resin in the present invention, but it is important that the resin used as the binder resin should have an electroconductivity of $1.0\times10^{-9}$ to $5.0\times10^{-9}$ (s/cm), preferably $1.0\times10^{-9}$ to $3.0\times10^{-9}$ s/cm), as pointed out hereinbefore. Moreover, a resin having an excellent light-transmitting property is preferably used. It also is important that the binder resin should have a melting point of 80° to 130° C., preferably 90° to 110° C.

As the resin having such characteristics, polyester, polystyrene, polyacrylic, polyamide and polyolefin resins can be used singly or in the form of mixtures of two or more of them.

In specific examples of the polyester resin, there is an polyester derived from an aromatic dicarboxylic acid or a fatty acid 1, as the acid component and a diol. As examples of the acid component, there can be mentioned terephthalic acid, isophthalic acid, naphthalene-dicarboxylic acid, maleic acid, fumaric acid, succinic acid, adipic acid, sebacic acid and cyclohexane-dicarboxylic acid. Terephthalic acid is mainly used. As the diol component, there can be mentioned, for example, ethylene glycol, propylene glycol, diethylene glycol, butanediol, cyclohexane dimethanol, hexylene glycol, triethylene glycol, glycerol, mannitol and pentaerythritol.

Specific examples of the styrene resin include polymers obtained by polymerizing such monomers as styrene, α-methylstyrene, vinyltoluene, α-chlorostyrene, o-chlorostyrene, m-chlorostyrene, p-chlorostyrene, ethylstyrene and divinylstyrene singly or in combination.

As the acrylic resin, there can be used, for example, polymers obtained by polymerizing such monomers as ethyl acrylate, methyl methacrylate, butyl methacrylate, 2-ethyl-hexyl methacrylate, acrylic acid and methacrylic acid singly or in combination. As the comonomer other than the above-mentioned monomers, there can be used ethylenically unsaturated acid and anhydrides thereof, such as maleic anhydride, fumaric acid, maleic acid, crotonic acid and itaconic acid.

Polymers comprising vinyl-n-butyl ether, vinylphenyl ether, vinylcyclohexanyl ether or the like can be used as the vinyl ether resin.

Known resins derived from a diamine and a dicarboxylic acid and resins formed by polymerizing a lactam, such as nylon 6, can be used as the polyamide resin.

Polymers formed by polymerizing ethylene, propylene, butene-1, pentene-1, methylpentene-1 or like the can be mentioned as the olefin resin.

The foregoing resin can be used singly, or two or more of the foregoing resins can be combined so that the above-mentioned electroconductivity is attained, and resulting mixtures can be used as the binder resin.

In the present invention , in view of the electroconductivity, light-transmitting property and melt viscosity characteristics, a polyester resin is preferably used.

Color Agent

The coloring agent to be contained in the coloring resin is roughly divided magenta, cyan and yellow pigments. Preferably, the coloring agent is incorporated in the binder resin an amount of 1 to 20% by weight based on the binder resin.

A quinacridone pigment is especially preferably used as the magenta coloring agent because the quinacridone pigment has a good dispersibility in the binder resin. The quinacridone pigment is represented by the following formula:

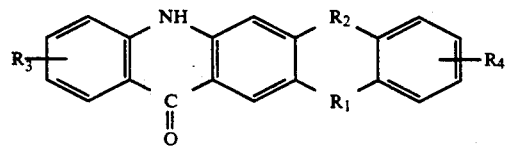

Wherein $R_1$ and $R_2$ represent an imino group or a carbonyl group, and $R_3$ and $R_4$ represent a hydrogen atom, an alkyl group or a halogen atom.

A copper phthalocyanine pigment is preferably used as the cyan coloring agent because the copper phthalocyanine pigment has a good dispersibility in the binder resin. The copper phthalocyanine pigment is represented by the following formula:

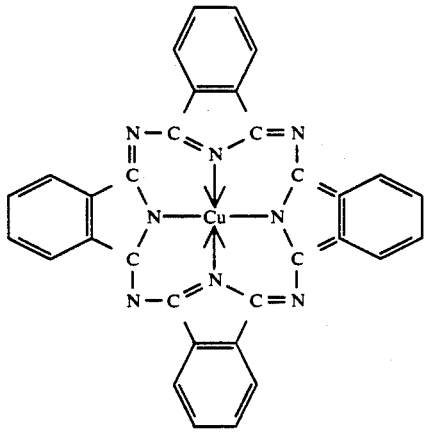

and the benzene nucleus of the structural formula can be substituted with an alkyl group or a halogen atom.

As the benzidine pigment, there can be mentioned, Benzidine Yellow GR, Benzidine Yellow G and etc.

Other Components

A charge-controlling agent can be incorporated into the binder resin for controlling the charging of the toner. A known charge-controlling agent can be used in the present invention. For example, there can be mentioned oil-soluble dyes such as Nigrosine Base (C.I. 50415), Oil Black (C.I. 26150) and Spiron Black, metal salts of naphthenic acid, metal soaps, metal-containing azo dyes, pyrimidine compounds and metal chelates of alkylsalicylic acids. A zinc salt or zinc complex of salicylic acid and a zinc salt or zinc complex of an alkylsalicylic acid are preferably used as the charge-controlling agent. It is preferred that the charge-controlling agent be incorporated in the binder resin in an amount of 0.5 to 5.0% by weight based on the binder resin.

Toner

The toner for the full color development, prepared from the foregoing components, preferably has such a particle size that the median diameter based on the volume, measured by a Coulter Counter, is 5 to 20 μm, especially 8 to 15 μm. The flowability of the toner can be improved by sprinkling inorganic fine particles such as hydrophobic silica fine particles or organic fine particles composed of a polymer or the like on the surface of the toner.

(1) Magenta Toner

In the present invention, it is important that when the magenta toner is formed into a layer having a thickness of 0.9 μm, the coloring agent particles appearing on the formed surface should be fine particles and the area occupied by the dispersed magenta coloring agent in 780,000 $\mu m^2$ of the area of the formed surface should be such that the number of particles having a size of 10 to 12.5 $\mu m^2$ is smaller than 40, especially smaller than 30, and the number of particles having a size of 12.5 to 15.0 $\mu m^2$ is smaller than 20, especially smaller than 10. It is preferred that when the transmission T (%) at 550 nm of the toner is lower than 2%, the transmission T (%) at 440 nm of the toner be at least 40%, especially at least 45%.

(2) Cyan Toner

In the present invention, it is important that when the cyan toner is formed into a layer having a thickness of 0.9 μm, the coloring agent particles appearing on the formed surface should be fine particles and the area occupied by the dispersed cyan coloring agent in 780,000 $\mu m^2$ of the area of the formed surface should be such that the number of particles having a size of 10 to 12.5 $\mu m^2$ is smaller than 80, especially smaller than 70, and the number of particles having a size of 12.5 to 15.0 $\mu m^2$ is smaller than 50, especially smaller than 40. It is preferred that when the transmission T (%) at 600 nm of the toner is lower than 2%, the transmission T (%) at 490 nm of the toner be at least 70%, especially at least 75%.

(3) Yellow Toner

In the present invention, it is important that when the yellow toner is formed into a layer having a thickness of 0.9 μm, the coloring agent particles appearing on the formed surface should be fine particles and the area occupied by the dispersed yellow coloring agent in 780,000 $\mu m^2$ of the area of the formed surface should be such that the number of particles having a size of 10 to 12.5 $\mu m^2$ is smaller than 15, especially smaller than 10, and the number of particles having a size of 12.5 to 15.0 $\mu m^2$ is smaller than 10, especially smaller than 5. It is preferred that when the transmission T (%) at 400 nm of the toner is lower than 2%, the transmission T (%) at 550 nm of the toner be at least 75%, especially at least 80%.

In the case where the above-mentioned toner is used as a two-component type developer by mixing it with a magnetic carrier, any of known magnetic carriers used in this field can be used, but use of ferrite particles capable of forming a soft magnetic brush is generally preferred.

As is apparent from the foregoing description, according to the present invention, by limiting the number of particles having a size of 10 to 12.5 $\mu m^2$ and particles having a size of 12.5 to 15.0 $\mu m^2$ among coloring agent particles dispersed in the binder resin below certain values, the light-transmitting property can be improved in any of magenta, cyan and yellow toners. Accordingly, these toners having an improved light-transmitting property are preferably used for the full color development where the toners are used in the overlapped state.

Furthermore, according to the present invention, by using a resin having an electroconductivity of $1.0\times10^{-9}$ to $5.0\times10^{-9}$ (s/cm) as the binder resin of the toner, the differences of electric characteristics among toners used in the overlapped state for the full color development can be diminished. If the differences of electric characteristics among the toners can be diminished, the development conditions for the full color development can be made substantially the same among the toners. Therefore, the difference of the transfer quantity among the toners can be reduced and the full color treatment can be performed with an excellent image reproducibility.

The present invention will now be described in detail with reference to the following examples.

(Experiment 1)

EXAMPLE

Example 1-1

(1) Preparation of Magenta Toner

A polyester resin as the binder resin, a quinacridone pigment as the coloring agent and, optionally, a charge-controlling agent were sufficiently kneaded, pulverized and classified to obtain a toner having a particle size of 5 to 15 μm.

The kneading was conducted so that when the toner was formed into a layer having a thickness of 0.9 μm, in the area of 780,000 $\mu m^2$ of the formed surface of the toner, the number of present coloring agent particles having a size of 10.0 to 12.5 $\mu m^2$ was 30 and the number of present coloring agent particles having a size of 12.5 to 15.0 $\mu m^2$ was 10.

As shown in Table 1, the transmission T (%) of the obtained toner at 550 nm was 2% and the transmission T (%) at 440 nm was 48%. The relation between the wavelength and the transmission is shown in FIG. 2.

The above toner was mixed with a known magnetic ferrite carrier to form a two-component developer.

(2) Preparation of Cyan Toner

The same binder resin as used for the magenta toner was used, and a copper phthalocyanine pigment was used as the coloring agent. These components were kneaded so that when the toner was formed into a layer having a thickness of 0.9 μm, in the area of 780,000 $\mu m^2$ of the formed surface of the toner, the number of present coloring agent particles having a size of 10.00 to 12.5 $\mu m^2$ was 60 and the number of present coloring agent particles having a size of 12.5 to 15.0 $\mu m^2$ was 35.

The toner was mixed with a known magnetic ferrite carrier to form a two-component developer.

(3) Preparation of Yellow Toner

The same binder resin as used for the magenta toner was used, and a benzidine pigment was used as the coloring agent. These components were kneaded so that when the toner was formed into a layer having a thickness of 0.9 μm, in the area of 780,000 $\mu m^2$ of the formed surface of the toner, the number of present coloring agent particles having a size of 10.00 to 12.5 $\mu m^2$ was 10 and the number of present coloring agent particles having a size of 12.5 to 15.0 $\mu m^2$ was 5.

The toner was mixed with a known magnetic ferrite carrier to form a two-component developer.

The toners (1) through (3) were subjected to the full color development under same conditions shown in Table 1 and were overlapped on a transfer material.

In the following Examples, the image characteristics were measured and evaluated in the following manners.

1. Evaluation of the transparency of an image

Spectral characteristics of reflected light and transmitted light were measured by "U-3210 type self-recording spectrophotometer" made by Hitachi Limited.

i) Magenta toner (Table 1)

As a control standard, the magenta toner alone in Table 1 was obtained in Table 1 was developed, and the reflectance of the resulting image at a wavelength of 700 nm (Y) was measured.

Then, a combination of the magenta toner in Table 1 and the yellow toner in Experiment 1-1 was developed, and the reflectance of the resulting image at a wavelength of 700 nm (X) was measured to seek the following formula;

$$\left(\begin{array}{c}\text{decrease ratio of the}\\ \text{reflectance of the image}\end{array}\right) = \frac{Y - X}{Y} \times 100(\%)$$

When the decrease ratio and the evaluation of the transparency of the magenta toner in an actual full color image are compared by visual observation, the results are that when it is smaller than 10%, the visual observation is good; when it is 10 to 15%, the visual observation is fair; and when it is larger than 15%, the visual observation is bad. Accordingly, as a measure of transparency, the decrease ratio mentioned above was used. This is the same in the case of a cyan toner and a yellow toner.

ii) Cyan toner (Table 2)

As a control standard, the cyan toner only shown in Table 2 was developed, and the reflectance (Y) of the image at a wavelength of 450 to 550 nm was measured, and a combination of the cyan toner in Table 2 and the yellow toner of Experiment 1-1 was developed, and the reflectance (X) of the developed image at a wavelength of 450 to 550 nm was measured. The decrease ratio of the reflectances of images was sought.

iii) Yellow toner (Table 3)

As a control standard, the reflectance (Y) of the image at a wavelength of 700 nm using the yellow toner alone in Table 3 and the reflectance (X) of the image at a wavelength of 700 nm using a combination of the yellow toner in Table 3 and the yellow toner in Experiment 1-1 were measured to seek the image reflectances.

2. Evaluation of the sharpness of the image (i) Magenta toner (Tables 1 and 4)

With respect to an image using an image using a combination of the magenta toner of Table 1 or 4 and the cyan toner of Experiment 1-1, a balance between the reflectance peak value at a wavelength of 400 to 500 nm and an absorption maximum value at a wavelength of 500 to 600 nm was calculated. When this balance (%) and the evaluation of the sharpness of a magenta toner in an actual full color image by a visual observation were compared, it was found that when the result was larger than 25% by visual observation, it was good; when the result was 20 to 25%, it was fair; and when the result was smaller than 20%, it was bad. The above balance was used as a measure of sharpness. This was the same in regard to the cyan toner.

(ii) Cyan toner (Tables 2 and 5)

The difference between the reflectance peak value at a wavelength of 400 to 500 nm of an image developed with a combination of the cyan toner of Table 2 or 5 and the magenta toner of Experiment 1-1 and the absorption maximum value at a wavelength of 500 to 600 nm was measured.

(iii) Yellow toner (Tables 3 and 6)

The difference between the reflectance peak value at a wavelength of 450 to 550 nm of an image developed with a combination of the yellow toner of Table 3 or 6 and the magenta toner of Experiment 1-1 and the absorption maximum value at a wavelength of 550 to 650 nm was measured.

When this difference (%) and the evaluation of the sharpness of a magenta toner in an actual full color image by a visual observation were compared, it was found that when the result was larger than 40% by visual observation, it was good; when the result was 35 to 40%, it was fair; and when it was smaller than 35%, it was bad. The above values were used as a measure of sharpness.

3. Density unevenness (Table 4 to 6)

A solid image having a size of 2 cm×2 cm was copied, and by using a Macbeth Reflection Densitometer RF-918, an image density difference was measured by using a measuring area of 4 mm. When the result was compared with that obtained by an evaluation with visual observation, the result was good when the concentration difference is less than 0.1; the result was fair when the concentration difference is 0.1 to 0.2; and the result was bad when the concentration difference is larger than 0.2.

The results of measurement are shown in each of the Tables.

Experiments 1-2 through 1-5

(1) Preparation of Magenta Toner

In the same manner as described in Experiment 1-1, a toner having a particle size of 5 to 15 $\mu m$ was prepared, and the numbers of coloring agent particles and the transmissions of the toner were as shown in Table 1.

The obtained toner was formed in a two-component developer in the same manner as described in Experiment 1-1.

The same cyan and yellow toners as used in Experiment 1-1 were used.

The image formed by using these toners was evaluated in the same manner as described in Experiment 1-1. The results of the evaluation are shown in Table 1.

Experiment 1-6

(1) Preparation of Magenta Toner

A polyester resin as the binder resin, a quinacridone pigment as the coloring agent and, optionally, a charge-controlling agent were sufficiently kneaded, pulverized and classified to obtain a toner having a particle size of 5 to 15 $\mu m$.

This kneading was conducted so that when the toner was formed into a layer having a thickness of 0.9 μm, in the area of 780,000 $\mu m^2$ of the formed surface of the toner, the number of present coloring agent particles having a size of 10.0 to 12.5 $\mu m^2$ was 120 and the number of present coloring agent particles having a size of 12.5 to 15.0 $\mu m^2$ was 80.

The transmission T (%) of the obtained toner at 550 nm was 1.5% and the transmission T (%) at 440 nm was 20%. The relation between the wavelength and the transmission is shown in FIG. 1.

The image formed by using this magenta toner and the same cyan and yellow toners as used in Experiment 1-1 was evaluated in the same manner as described in Experiment 1-1. The obtained image was dark and was extremely poor in the transparency and sharpness.

(2) Preparation of Yellow Toner

The same binder resin as used for the cyan toner was used, and a benzidine pigment was used as the coloring agent. These components were kneaded so that when the toner was formed into a layer having a thickness of 0.9 μm, in the area of 780,000 $\mu m^2$ of the formed surface of the toner, the number of present coloring agent particles having a size of 10.00 to 12.5 $\mu m^2$ was 10 and the number of present coloring agent particles having a size of 12.5 to 15.0 $\mu m^2$ was 5.

The toner was mixed with a known magnetic ferrite carrier to form a two-component developer.

(3) Preparation of Magenta Toner

The same binder resin as used for the cyan toner was used, and a quinacridone pigment was used as the coloring agent. These components were kneaded so that when the toner was formed into a layer having a thickness of 0.9 μm, in the area of 780,000 $\mu m^2$ of the formed surface of the toner, the number of present coloring agent particles having a size of 10.00 to 12.5 $\mu m^2$ was 30 and the number of present coloring agent particles having a size of 12.5 to 15.0 $\mu m^2$ was 10.

The toner was mixed with a known magnetic ferrite carrier to form a two-component developer.

TABLE 1

| Experiment No. | 1-1 | 1-2 | 1-3 | 1-4 | 1-5 |
|---|---|---|---|---|---|
| Components | | | | | |
| toner | | | | | |
| binder resin | polyester | styrene-acrylic | polyester | polyester | polyester |
| coloring agent | *1 | *1 | *1 | *2 | *1 |
| charge-controlling agent | *3 | *3 | *3 | *3 | *3 |
| number of coloring agent particles having size of 10 to 12.5 $\mu m^2$ | 30 | 35 | 35 | 37 | 44 |
| number of coloring agent particles having size of 12.5 to 15 $\mu m^2$ | 10 | 14 | 18 | 16 | 22 |
| transmission of toner, | | | | | |
| (550 nm) T % | 2.0 | 1.5 | 2.0 | 1.7 | 1.5 |
| (440 nm) T % | 48 | 42 | 43 | 39 | 36 |
| carrier | | | | | |
| kind | ferrite | ferrite | ferrite | ferrite | ferrite |
| charge quantity of developer (μc/g) | 20 | 19 | 18 | 18 | 17 |
| Development Conditions | | | | | |
| surface voltage of photosensitive material (V) | 700 | 720 | 700 | 700 | 720 |
| bias voltage of developer (V) | 470 | 480 | 470 | 470 | 470 |
| peripheral speed of photosensitive material/ peripheral speed of developing sleeve | 2.0 | 2.2 | 2.0 | 2.0 | 2.0 |
| cut brush length (mm) | 0.6 | 0.6 | 0.6 | 0.7 | 0.6 |
| photosensitive material - developing sleeve distance (mm) | 0.7 | 0.7 | 0.7 | 0.7 | 0.7 |
| Results of Evaluation | | | | | |
| State of image | | | | | |
| transparency | ○3% | ○4% | ○5% | X18% | Δ12% |
| sharpness | ○30% | ○28% | ○27% | X15% | X18% |

Note:
*1: quinacridone type. *2: rhodamine type. *3: salicylic acid-zinc complex.
○: good, Δ: fair, X: bad (Experiment 2)

Experiment 2-1

(1) Preparation of Cyan Toner

A polyester resin as the binder resin, a copper phthalocyanine pigment as the coloring agent and, optionally, a charge-controlling agent were sufficiently kneaded, pulverized and classified to obtain a toner having a particle size of 8 to 15 μm.

This kneading was conducted so that when the toner was formed into a layer having a thickness of 0.9 μm, in the area of 780,000 $\mu m^2$ of the formed surface of the toner, the number of present coloring agent particles having a size of 10.0 to 12.5 $\mu m^2$ was 60 and the number of present coloring agent particles having a size of 12.5 to 15.0 $\mu m^2$ was 35.

As shown in Table 2, the transmission T (%) of the obtained toner at 600 nm was 1.0% and the transmission T (%) at 490 nm was 76%. The relation between the wavelength and the transmission is shown in FIG. 4.

The above toner was mixed with a known magnetic ferrite carrier to form a two-component developer.

The toners (1) through (3) were subjected to the full color development under same conditions shown in Table 2 and were overlapped on a transfer material. The formed image was evaluated. The results of the evaluation are shown in Table 2.

Experiments 2-2 through 2-3

(1) Preparation of Cyan Toner

In the same manner as described in Experiment 2-1, a toner having a particle size of 8 to 15 μm was prepared, and the numbers of coloring agent particles and the transmissions of the toner were as shown in Table 2.

The obtained toner was formed in a two-component developer in the same manner as described in Experiment 2-1.

The same magenta and yellow toners as used in Experiment 2-1 were used.

The image formed by the full color development using these toners was evaluated in the same manner as described in Experiment 2-1. The results of the evaluation are shown in Table 2.

layer having a thickness of 0.9 μm, in the area of 780,000 $\mu m^2$ of the formed surface of the toner, the number of present coloring agent particles having a size of 10.0 to 12.5 $\mu m^2$ was 78 and the number of present coloring agent particles having a size of 12.5 to 15.0 $\mu m^2$ was 53.

This cyan toner and the same magenta and yellow toners as used in Experiment 2-1 were subjected to the full color development and were overlapped on a transfer material to form an image. The formed image was evaluated. The image was poor in the sharpness.

TABLE 2

| Experiment No. | 2-1 | 2-2 | 2-3 | 2-4 | 2-5 |
|---|---|---|---|---|---|
| Components | | | | | |
| toner | | | | | |
| binder resin | polyester | polyester | styrene-acrylic | polyester | polyester |
| coloring agent | *1 | *1 | *1 | *1 | *1 |
| charge-controlling agent | *2 | *2 | *2 | *2 | *2 |
| number of coloring agent particles having size of 10 to 12.5 $\mu m^2$ | 60 | 70 | 65 | 110 | 78 |
| number of coloring agent particles having size of 12.5 to 15 $\mu m^2$ | 35 | 40 | 43 | 80 | 53 |
| transmission of toner, | | | | | |
| (490 nm) T % | 76 | 74 | 72 | 64 | 68 |
| (600 nm) T % | 1.0 | 1.0 | 0.5 | 0.5 | 1.0 |
| carrier | | | | | |
| kind | ferrite | ferrite | ferrite | ferrite | ferrite |
| charge quantity of developer (μc/g) | 20 | 18 | 19 | 22 | 20 |
| Development Conditions | | | | | |
| surface voltage of photosensitive material (V) | 700 | 710 | 700 | 700 | 710 |
| bias voltage of developer (V) | 470 | 480 | 470 | 470 | 480 |
| peripheral speed of photosensitive material/ peripheral speed of developing sleeve | 2.5 | 2.0 | 2.0 | 2.0 | 2.0 |
| cut brush length (mm) | 0.6 | 0.6 | 0.7 | 0.8 | 0.7 |
| photosensitive material - developing sleeve distance (mm) | 0.7 | 0.7 | 0.7 | 0.7 | 0.7 |
| Results of Evaluation | | | | | |
| State of image | | | | | |
| transparency | ○5% | ○7% | ○7% | X19% | Δ13% |
| sharpness | ○30% | ○29% | ○27% | X18% | X19% |

Note:
*1: copper phthalocyanine, *2: salicylic acid/zinc complex
○: good, Δ: fair, X: bad Experiment 2-4

(1) Preparation of Cyan Toner

A polyester resin as the binder resin, a copper phthalocyanine pigment as the coloring agent and, optionally, a charge-controlling agent were sufficiently kneaded, pulverized and classified to obtain a toner having a particle size of 8 to 15 μm.

This kneading was conducted so that when the toner was formed into a layer having a thickness of 0.9 μm, in the area of 780,000 $\mu m^2$ of the formed surface of the toner, the number of present coloring agent particles having a size of 10.0 to 12.5 $\mu m^2$ was 110 and the number of present coloring agent particles having a size of 12.5 to 15.0 $\mu m^2$ was 80.

The transmission T (%) of the obtained toner at 600 nm was 0.5% and the transmission T (%) at 490 nm was 64%. The relation between the wavelength and the transmission is shown in FIG. 3.

The image formed by using this cyan toner and the same magenta and yellow toners as used in Experiment 2-1 was evaluated in the same manner as described in Experiment 2-1. The obtained image was dark and was extremely poor in the transparency and sharpness.

Experiment 2-5

(1) Preparation of Cyan Toner

A cyan toner was prepared in the same manner as described in Experiment 2-4 except that kneading was carried out so that when the toner was formed into a (Experiment 3)

Experiment 3-1

(1) Preparation of Yellow Toner

A polyester resin as the binder resin, a benzidine pigment as the coloring agent and, optionally, a charge-controlling agent were sufficiently kneaded, pulverized and classified to obtain a toner having a particle size of 5 to 15 μm.

This kneading was conducted so that when the toner was formed into a layer having a thickness of 0.9 μm, in the area of 780,000 $\mu m^2$ of the formed surface of the toner, the number of present coloring agent particles having a size of 10.0 to 12.5 $\mu m^2$ was 10 and the number of present coloring agent particles having a size of 12.5 to 15.0 $\mu m^2$ was 6.

As shown in Table 3, the transmission T (%) of the obtained toner at 400 nm was 2% and the transmission T (%) at 550 nm was 80%. The relation between the wavelength and the transmission is shown in FIG. 6.

The above toner was mixed with a known magnetic ferrite carrier to form a two-component developer.

(2) Preparation of Magenta Toner

The same binder resin as used for the yellow toner was used, and a quinacridone pigment was used as the coloring agent. These components were kneaded so that when the toner was formed into a layer having a thickness of 0.9 μm, in the area of 780,000 μm² of the formed surface of the toner, the number of present coloring agent particles having a size of 10.00 to 12.5 μm² was 30 and the number of present coloring agent particles having a size of 12.5 to 15.0 μm² was 10.

The toner was mixed with a known magnetic ferrite carrier to form a two-component developer.

(3) Preparation of Cyan Toner

The same binder resin as used for the yellow toner was used, and a copper phthalocyanine pigment was used as the coloring agent. These components were kneaded so that when the toner was formed into a layer having a thickness of 0.9 μm, in the area of 780,000 μm² of the formed surface of the toner, the number of present coloring agent particles having a size of 10.00 to 12.5 μm² was 60 and the number of present coloring agent particles having a size of 12.5 to 15.0 μm² was 35.

The toner was mixed with a known magnetic ferrite carrier to form a two-component developer.

The toners (1) through (3) were subjected to the full color development under same conditions shown in Table 3 and were overlapped on a transfer material. The formed image was evaluated. The results of the evaluation are shown in Table 3.

Experiments 3-2 through 3-4

(1) Preparation of Yellow Toner

In the same manner as described in Experiment 3-1, a toner having a particle size of 5 to 15 μm was prepared, and the numbers of coloring agent particles and the transmissions of the toner were as shown in Table 3.

The obtained toner was formed in a two-component developer in the same manner as described in Experiment 3-1.

The same magenta and cyan toners as used in Experiment 3-1 were used.

The image formed by the full color development using these toners was evaluated in the same manner as described in Experiment 3-1. The results of the evaluation of the image of the toners overlapped on a transfer material are shown in Table 3.

Experiment 3-5

(1) Preparation of Yellow Toner

A polyester resin as the binder resin, a benzidine pigment as the coloring agent and, optionally, a charge-controlling agent were sufficiently kneaded, pulverized and classified to obtain a toner having a particle size of 5 to 15 μm.

This kneading was conducted so that when the toner was formed into a layer having a thickness of 0.9 μm, in the area of 780,000 μm² of the formed surface of the toner, the number of present coloring agent particles having a size of 10.0 to 12.5 μm² was 30 and the number of present coloring agent particles having a size of 12.5 to 15.0 μm² was 25.

The transmission T (%) of the obtained toner at 400 nm was 2.0% and the transmission T (%) at 550 nm was 62%. The relation between the wavelength and the transmission is shown in FIG. 5.

The image formed by the full color development using this yellow toner and the same magenta and cyan toners as used in Experiment 3-1 was evaluated in the same manner as described in Experiment 3-1. The obtained image had a density unevenness and was poor in the sharpness.

TABLE 3

| Experiment No. | 3-1 | 3-2 | 3-3 | 3-4 | 3-5 |
|---|---|---|---|---|---|
| Components | | | | | |
| toner | | | | | |
| binder resin | polyester | styrene-acrylic | polyester | polyester | styrene-acrylic |
| coloring agent | *1 | *1 | *2 | *1 | *1 |
| charge-controlling agent | *3 | *3 | *3 | *3 | *3 |
| number of coloring agent particles having size of 10 to 12.5 μm² | 10 | 12 | 11 | 17 | 20 |
| number of coloring agent particles having size of 12.5 to 15 μm² | 6 | 9 | 7 | 12 | 10 |
| transmission of toner. | | | | | |
| (400 nm) T % | 2.0 | 2.0 | 1.5 | 1.5 | 2.0 |
| (550 nm) T % | 80 | 76 | 78 | 60 | 62 |
| carrier | | | | | |
| kind | ferrite | ferrite | ferrite | ferrite | ferrite |
| charge quantity of developer (μc/g) | 18 | 22 | 20 | 19 | 23 |
| Development Conditions | | | | | |
| surface voltage of photosensitive material (V) | 700 | 700 | 710 | 700 | 710 |
| bias voltage of developer (V) | 470 | 470 | 480 | 470 | 480 |
| peripheral speed of photosensitive material/ peripheral speed of developing sleeve | 2.0 | 2.0 | 2.0 | 2.0 | 2.0 |
| cut brush length (mm) | 0.6 | 0.6 | 0.6 | 0.6 | 0.6 |
| photosensitive material - developing sleeve distance (mm) | 0.7 | 0.7 | 0.7 | 0.7 | 0.7 |
| Results of Evaluation | | | | | |
| State of image | | | | | |
| transparency | ○3% | ○5% | ○7% | Δ13% | X18% |
| sharpness | ○45% | ○43% | ○42% | X32% | X29% |

Note:
*1: benzidine pigment, *2: nitro pigment, *3: salicylic acid/zinc complex
○: good, Δ: fair, X: bad (Experiment 4)

Experiment 4-1

A toner having an average particle size of 10 μm and an electroconductivity of $2.5\times10^{-9}$ (s/cm) was prepared by kneading 100 parts by weight of a polyester resin having an electroconductivity of $2.5\times10^{-9}$ (s/cm) and a melting point of 90° as the binder resin and 4.0 parts by weight of a quinacridone pigment as the coloring agent so that when the obtained toner was formed in a layer having a thickness of 0.9 μm, in the area of 780,000 $\mu m^2$ of the formed surface of the toner, the number of present dipsersed particles having a size of 10 to 12.5 $\mu m^2$ was 29 and the number of present dispersed particles having a size of 12.5 to 15.0 $\mu m^2$ was 8.

A toner having an average particle size of 10 $\mu$m and an electroconductivity of $2.6\times10^{-9}$ (s/cm) was prepared by kneading 100 parts by weight of the same binder resin as used above and 3.0 parts by weight of a benzidine pigment as a yellow coloring agent so that when the obtained toner was formed into a layer having a thickness of 0.9 $\mu$m, in the area of 780,000 $\mu m^2$ of the formed surface of the toner, the number of present pigment particles having a size of 10.0 to 12.5 $\mu m^2$ was 10 and the number of present particles having a size of 12.5 to 15.0 $\mu m^2$ was 5.

A toner having an average particle size of 10 $\mu$m and an electroconductivity of $2.5\times10^{-9}$ (s/cm) was prepared by kneading 100 parts by weight of the same binder resin as described above and 4.0 parts by weight of a copper phthalocyanine as a cyan coloring pigment so that when the obtained toner was formed in a layer having a thickness of 9 $\mu$m, in the area of 780,000 $\mu m^2$ of the formed surface of the toner, the number of present dispersed pigment particles having a size of 10.0 to 12.5 $\mu m^2$ was 58 and the number of present dispersed pigment particles was 36.

A black toner having an electroconductivity of $2.7\times10^{-9}$ (s/cm) was prepared by using 100 parts by weight of the binder resin and 4 parts by weight of carbon black according to customary procedures.

The foregoing toners were independently mixed with a known ferrite carrier to prepare respective color developers. These developers were subjected to the full color development under same developing conditions and were overlapped on a transfer material to obtain a full color image. With respect to each developed toner, the toner transfer efficiency was determined by using an A-4 original having an image area ratio of 20%. The obtained results are shown in Table 4.

Experiments 4-2 through 4-5

The experiments were carried out in the same manner as described in Experiment 4-1 except that the electroconductivity and melting temperature of the binder resin, the magenta coloring agent and the dispersion states of the coloring agents in the toners were changed as shown in Table 4. The obtained results are shown in Table 4.

From the results obtained in Experiments 4-1 and 4-2, it is seen that in the magenta toner of the present invention, the developing and transfer characteristics can be made almost equal to those of other color toners and this magenta toner is excellent in the transparency and coloring property, and therefore, a sharp full color image can be provided without any density unevenness.

TABLE 4

| Experiment No. | Electroconductivity of Resin (s/cm) | Melting Temperature of Resin (°C.) | Coloring Agent | Electroconductivity of Toner (s/cm) black | cyan | magenta | yellow |
|---|---|---|---|---|---|---|---|
| 4-1 | $2.5\times10^{-9}$ | 90 | quinacridone | $2.7\times10^{-9}$ | $2.5\times10^{-9}$ | $2.5\times10^{-9}$ | $2.6\times10^{-9}$ |
| 4-2 | $3.0\times10^{-9}$ | 120 | quinacridone | $3.1\times10^{-9}$ | $3.1\times10^{-9}$ | $3.0\times10^{-9}$ | $3.1\times10^{-9}$ |
| 4-3 | $2.5\times10^{-9}$ | 90 | thioindigo | $2.7\times10^{-9}$ | $2.5\times10^{-9}$ | $3.3\times10^{-9}$ | $2.6\times10^{-9}$ |
| 4-4 | $6.0\times10^{-9}$ | 100 | quinacridone | $7.9\times10^{-9}$ | $5.8\times10^{-9}$ | $6.3\times10^{-9}$ | $5.3\times10^{-9}$ |
| 4-5 | $8.9\times10^{-10}$ | 100 | quinacridone | $1.5\times10^{-9}$ | $8.9\times10^{-10}$ | $8.8\times10^{-10}$ | $8.9\times10^{-10}$ |

| Experiment No. | Developed Toner Quantity (mg) black | cyan | magenta | yellow | Transfer Efficiency (%) black | cyan | magenta | yellow | Dispersion State of Coloring Agent (number of particles) cyan 10 ∫ 12.5 | cyan 12.5 ∫ 15.0 | magenta 10 ∫ 12.5 | magenta 12.5 ∫ 15.0 | yellow 10 ∫ 12.5 | yellow 12.5 ∫ 15.0 | Image Characteristics density unevenness | sharpness |
|---|---|---|---|---|---|---|---|---|---|---|---|---|---|---|---|---|
| 4-1 | 78 | 76 | 77 | 76 | 77 | 75 | 76 | 76 | 58 | 36 | 29 | 8 | 10 | 5 | ○0.10 | ○28% |
| 4-2 | 81 | 80 | 79 | 79 | 74 | 73 | 73 | 74 | 56 | 33 | 38 | 19 | 11 | 7 | ○0.12 | Δ21% |
| 4-3 | 78 | 76 | 81 | 76 | 77 | 75 | 68 | 76 | 58 | 36 | 42 | 19 | 10 | 5 | X0.41 | X15% |
| 4-4 | 86 | 81 | 83 | 77 | 63 | 69 | 65 | 63 | 59 | 31 | 29 | 8 | 10 | 5 | X0.51 | Δ23% |
| 4-5 | 72. | 60 | 58 | 58 | 79 | 82 | 83 | 85 | 59 | 30 | 30 | 7 | 10 | 6 | X0.55 | Δ22% |

Note
○: good, Δ: fair, X: bad (Experiment 5)

Experiments 5-1 through 5-5

Experiments were carried out in the same manner as described in Experiment 4-1 except that the electroconductivity and melting point of the binder resin, the cyan coloring agent and the dispersion states of the coloring agents in the toners were changed as shown in Table 5. The obtained full color images were evaluated. The obtained results are shown in Table 5.

TABLE 5

| Experiment No. | Electroconductivity of Resin (s/cm) | Melting Temperature of Resin (°C.) | Coloring Agent | Electroconductivity of Toner (s/cm) black | cyan | magenta | yellow |
|---|---|---|---|---|---|---|---|
| 5-1 | $1.2\times10^{-9}$ | 90 | copper phthalocyanine | $1.4\times10^{-9}$ | $1.2\times10^{-9}$ | $1.3\times10^{-9}$ | $1.3\times10^{-9}$ |
| 5-2 | $4.3\times10^{-9}$ | 110 | copper phthalocyanine | $4.5\times10^{-9}$ | $4.3\times10^{-9}$ | $4.2\times10^{-9}$ | $4.3\times10^{-9}$ |
| 5-3 | $1.2\times10^{-9}$ | 90 | C.I. Solient Blue 25 | $1.4\times10^{-9}$ | $3.9\times10^{-9}$ | $1.3\times10^{-9}$ | $1.3\times10^{-9}$ |
| 5-4 | $5.5\times10^{-9}$ | 110 | copper | $8.4\times10^{-9}$ | $5.3\times10^{-9}$ | $5.7\times10^{-9}$ | $5.7\times10^{-9}$ |

TABLE 5-continued

| | | | | | | | |
|---|---|---|---|---|---|---|---|
| 5-5 | $8.5 \times 10^{-10}$ | 100 | phthalo-cyanine copper phthalo-cyanine | $1.3 \times 10^{-9}$ | $8.3 \times 10^{-10}$ | $8.3 \times 10^{-10}$ | $8.3 \times 10^{-10}$ |

| Experiment No. | Developed Toner Quantity (mg) | | | | Transfer Efficiency (%) | | | | Dispersion State of Coloring Agent (number of particles) cyan | | magenta | | yellow | | Image Characteristics | |
|---|---|---|---|---|---|---|---|---|---|---|---|---|---|---|---|---|
| | | | | | | | | | 10 ∫ 12.5 | 12.5 ∫ 15.0 | 10 ∫ 12.5 | 12.5 ∫ 15.0 | 10 ∫ 12.5 | 12.5 ∫ 15.0 | density uneven-ness | sharp-ness |
| | black | cyan | magen-ta | yellow | black | cyan | magen-ta | yellow | | | | | | | | |
| 5-1 | 75 | 73 | 75 | 73 | 76 | 75 | 76 | 76 | 60 | 30 | 29 | 9 | 9 | 5 | ○0.10 | ○30% |
| 5-2 | 84 | 80 | 81 | 82 | 71 | 72 | 72 | 73 | 78 | 46 | 33 | 11 | 10 | 5 | ○0.15 | Δ22% |
| 5-3 | 75 | 82 | 75 | 73 | 76 | 71 | 76 | 76 | — | — | 29 | 9 | 9 | 5 | X0.35 | Δ24% |
| 5-4 | 89 | 80 | 83 | 84 | 64 | 70 | 69 | 68 | 59 | 31 | 30 | 10 | 10 | 5 | X0.49 | ○29% |
| 5-5 | 75 | 60 | 61 | 62 | 76 | 79 | 80 | 80 | 61 | 31 | 28 | 7 | 10 | 6 | X0.58 | ○31% |

Note
○: good, Δ: fair, X: bad (Experiment 6)

Experiments 6-1 through 6-5

TABLE 6

| Experiment No. | Electroconductivity of Resin (s/cm) | Melting Temperature of Resin (°C.) | Coloring Agent | Electroconductivity of Toner (s/cm) black | cyan | magenta | yellow |
|---|---|---|---|---|---|---|---|
| 6-1 | $1.5 \times 10^{-9}$ | 90 | benzidine pigment | $1.8 \times 10^{-9}$ | $1.5 \times 10^{-9}$ | $1.6 \times 10^{-9}$ | $1.5 \times 10^{-9}$ |
| 6-2 | $2.5 \times 10^{-9}$ | 100 | benzidine pigment | $2.7 \times 10^{-9}$ | $2.5 \times 10^{-9}$ | $2.4 \times 10^{-9}$ | $2.5 \times 10^{-9}$ |
| 6-3 | $1.5 \times 10^{-9}$ | 90 | nitro pigment | $1.8 \times 10^{-9}$ | $1.5 \times 10^{-9}$ | $1.6 \times 10^{-9}$ | $1.7 \times 10^{-9}$ |
| 6-4 | $6.0 \times 10^{-9}$ | 100 | benzidine pigment | $6.5 \times 10^{-9}$ | $5.9 \times 10^{-9}$ | $5.9 \times 10^{-9}$ | $5.8 \times 10^{-9}$ |
| 6-5 | $7.9 \times 10^{-10}$ | 100 | benzidine pigment | $3.6 \times 10^{-9}$ | $7.7 \times 10^{-10}$ | $7.6 \times 10^{-10}$ | $7.9 \times 10^{-10}$ |

| Experiment No. | Developed Toner Quantity (mg) | | | | Transfer Efficiency (%) | | | | Dispersion State of Coloring Agent (number of particles) cyan | | magenta | | yellow | | Image Characteristics | |
|---|---|---|---|---|---|---|---|---|---|---|---|---|---|---|---|---|
| | | | | | | | | | 10 ∫ 12.5 | 12.5 ∫ 15.0 | 10 ∫ 12.5 | 12.5 ∫ 15.0 | 10 ∫ 12.5 | 12.5 ∫ 15.0 | density uneven-ness | sharp-ness |
| | black | cyan | magen-ta | yellow | black | cyan | magen-ta | yellow | | | | | | | | |
| 6-1 | 83 | 79 | 81 | 78 | 77 | 76 | 75 | 76 | 58 | 36 | 32 | 10 | 10 | 6 | ○0.09 | ○46% |
| 6-2 | 76 | 75 | 75 | 76 | 76 | 74 | 75 | 74 | 56 | 33 | 33 | 11 | 15 | 9 | ○0.15 | Δ37% |
| 6-3 | 83 | 79 | 81 | 83 | 77 | 76 | 76 | 73 | 58 | 36 | 32 | 10 | 14 | 10 | ○0.11 | X30% |
| 6-4 | 87 | 81 | 80 | 81 | 64 | 66 | 65 | 65 | 57 | 33 | 33 | 12 | 11 | 7 | X0.41 | Δ38% |
| 6-5 | 89 | 70 | 68 | 69 | 74 | 83 | 82 | 85 | 55 | 32 | 34 | 10 | 11 | 7 | X0.52 | ○41% |

Note
○: good, Δ: fair, X: bad

Various toners were prepared in the same manner as described in Experiment 5-1 except that the electroconductivity and melting point of the binder resin, the cyan coloring agent and the dispersion states of the coloring agents in the toners were changed as shown in Table 6, and images formed by the full color development using these toners were evaluated. The obtained results are shown in Table 6.

From the results obtained in Experiments 5-1 and 5-2, it is seen that in the cyan toner of the present invention, the developing and transfer characteristics can be made substantially equal to those of other color toners and this cyan toner is excellent in the transparency and coloring property, and therefore, a sharp full color image can be provided without any density unevenness.

From the results obtained in Experiments 6-1 and 6-2, it is seen that in the yellow toner of the present invention, the developing and transfer characteristics can be made substantially equal to those of other color toners and this cyan toner is excellent in the transparency and coloring property, and therefore, a sharp full color image can be provided without any density unevenness.

What we claim is:

1. A toner having an excellent transparency for full color development, which comprises a binder resin and a magenta coloring dispersed therein wherein (i) said magenta coloring agent is a quinacridone pigment, (ii) said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed pigment particles having a size of 10 to 12.5 $\mu m^2$ is smaller than 40 and the number of dispersed pigment particles having a size of 12.5 to 15.0 $\mu m^2$ is smaller than 20, and (iii) the binder resin has an electroconductivity of $1.0 \times 10^{-9}$ to $5.0 \times 10^{-9}$ (s/cm).

2. A toner for full color development according to claim 1, wherein the melting point of the binder resin is 80° to 130° C.

3. A toner for full color development according to claim 1, wherein the number of dispersed pigment particles having a size of 10 to 12.5 μm is smaller than 30 and the number of dispersed pigment particles having a size of 12.5 to 15.0 $\mu m^2$ is smaller than 10.

4. A toner having an excellent transparency for full color development according to claim 1, wherein said binder resin is a polyester resin.

5. A toner having an excellent transparency for full color development, which comprises a binder resin and a cyan coloring agent dispersed therein wherein (i) said cyan coloring agent is a copper phthalocyanine pigment, (ii) said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed pigment particles having a size of 10 to 12.5 $\mu m^2$ is smaller than 80 and the number of dispersed pigment particles having a size of 12.5 to 15.0 $\mu m^2$ is smaller than 50, and (iii) the binder resin has an electroconductivity of $1.0\times10^{-9}$ to $5.0\times10^{-9}$ (s/cm).

6. A toner for full color development according to claim 5, wherein the melting point of the binder resin is 80° to 130° C.

7. A toner for full color development according to claim 5, wherein the number of dispersed pigment particles having a size of 10 to 12.5 $\mu m^2$ is smaller than 70 and the number of dispersed pigment particles having a size of 12.5 to 15.0 $\mu m^2$ is smaller than 40.

8. A toner having an excellent transparency for full color development according to claim 5, wherein said binder resin is a polyester resin.

9. A toner having an excellent transparency for full color development, which comprises a binder resin and a yellow coloring agent dispersed therein wherein (i) said yellow coloring agent is a benzidine pigment, (ii) said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed pigment particles having a size of 10 to 12.5 $\mu m^2$ is smaller than 15 and the number of dispersed pigment particles having a size of 12.5 to 15.0 $\mu m^2$ is smaller than 10, and (iii) the binder resin has an electroconductivity of $1.0\times10^{-9}$ to $5.0\times10^{-9}$ (s/cm).

10. A toner for full color development according to claim 9, wherein the melting point of the binder resin is 80° to 130° C.

11. A toner for full color development according to claim 9, wherein the number of dispersed pigment particles having a size of 10 to 12.5 $\mu m^2$ is smaller than 10 and the number of dispersed pigment particles having a size of 12.5 to 15.0 $\mu m^2$ is smaller than 5.

12. A toner having an excellent transparency for full color development according to claim 9, wherein a said binder resin is a polyester resin.

13. A method of full color development, which comprises (1) exposing a photosensitive layer to a light from a multiple-color original through a color-separating filter to form an electrostatic image, (2) developing said electrostatic image by a toner, (3) transferring a toner image to a transfer material, and (4) repeating steps (1) to (3) using magenta, cyan, and yellow color toners and a black toner to form a multiple-color image in which each of the toner images is overlapped, wherein (A) said magenta toner is a toner comprising a binder resin and a quinacridone pigment, said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed quinacridone pigment particles having a size of 10 to 12.5 $\mu m^2$ is smaller than 40 and the number of dispersed quinacridone pigment particles having a size of 12.5 to 15.0 $\mu m^2$ is smaller than 20, and said binder resin has an electroconductivity of $1.0\times10^{-9}$ to $5.0\times10^{-9}$ (s/cm), (B) said cyan toner is a toner comprising a binder resin and a copper phthalocyanine pigment, said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed copper phthalocyanine pigment particles having a size of 10 to 12.5 $\mu m^2$ is smaller than 80 and the number of dispersed copper phthalocyanine pigment particles having a size of 12.5 to 15.0 $\mu m^2$ is smaller than 50, and said binder resin has an electroconductivity of $1.0\times10^{-9}$ to $5.0\times10^{-9}$ (s/cm), and (C) said yellow toner is a toner comprising a binder resin and a benzidine pigment, said pigment is dispersed in the binder resin in the form of fine particles and that when the toner is formed into a layer having a thickness of 0.9 μm, the area occupied by the dispersed pigment in 780,000 $\mu m^2$ of the area of the formed surface is such that the number of dispersed benzidine pigment particles having a size of 10 to 12.5 $\mu m^2$ is smaller than 15 and the number of dispersed benzidine pigment particles having a size of 12.5 to 15.0 $\mu m^2$ is smaller than 10, and said binder resin has an electroconductivity of $1.0\times10^{-9}$ to $5.0\times10^{-9}$ (s/cm).

* * * * *